United States Patent [19]

Danguillier et al.

[11] 3,990,820

[45] Nov. 9, 1976

[54] APPARATUS FOR DISCHARGING HOT LIQUID MATERIAL FROM A PRESSURE VESSEL

[75] Inventors: Wilhelm Danguillier; Siegfried Pohl, both of Bochum, Germany

[73] Assignee: Dr. C. Otto & Comp. G.m.b.H., Bochum, Germany

[22] Filed: Dec. 1, 1975

[21] Appl. No.: 636,359

[30] Foreign Application Priority Data

Dec. 12, 1974 Germany ..... 2458781

[52] U.S. Cl. ..... 425/10; 425/139; 425/143; 425/147; 425/155; 264/14

[51] Int. Cl.[2] ..... B22D 23/08

[58] Field of Search ..... 264/14; 425/139, 143, 425/147, 155, 455, 6, 10

[56] References Cited

UNITED STATES PATENTS

| | | | |
|---|---|---|---|
| 2,802,236 | 8/1957 | Nash | 425/6 X |
| 3,001,228 | 9/1961 | Nack | 425/6 X |

*Primary Examiner*—Robert L. Spicer, Jr.
*Attorney, Agent, or Firm*—Brown, Murray, Flick & Peckham

[57] ABSTRACT

Liquid slag passes from an overflow in a pressure vessel into an underlying collecting vessel where the liquid slag is transformed into solid granular material by quenching in a liquid coolant. A desired coolant level is maintained within the collecting vessel by control valves under a pressure above atmospheric pressure. Two slide valves in the bottom of the collecting vessel are opened to discharge the granular material after accumulating to a predetermined measured level which is below the liquid coolant in the collecting vessel. A discharge vessel, beneath the collecting vessel, receives the discharged granular material. The discharge vessel is filled with a liquid coolant under either atmospheric pressure or under the same elevated pressure as the pressure within the collecting vessel. When the pressure in the discharge vessel is at atmospheric pressure, two slide valves in the bottom of the discharge vessel are opened to discharge the solid granular material into an underlying container which includes a scraper conveyor to transport the solid granular material.

10 Claims, 1 Drawing Figure

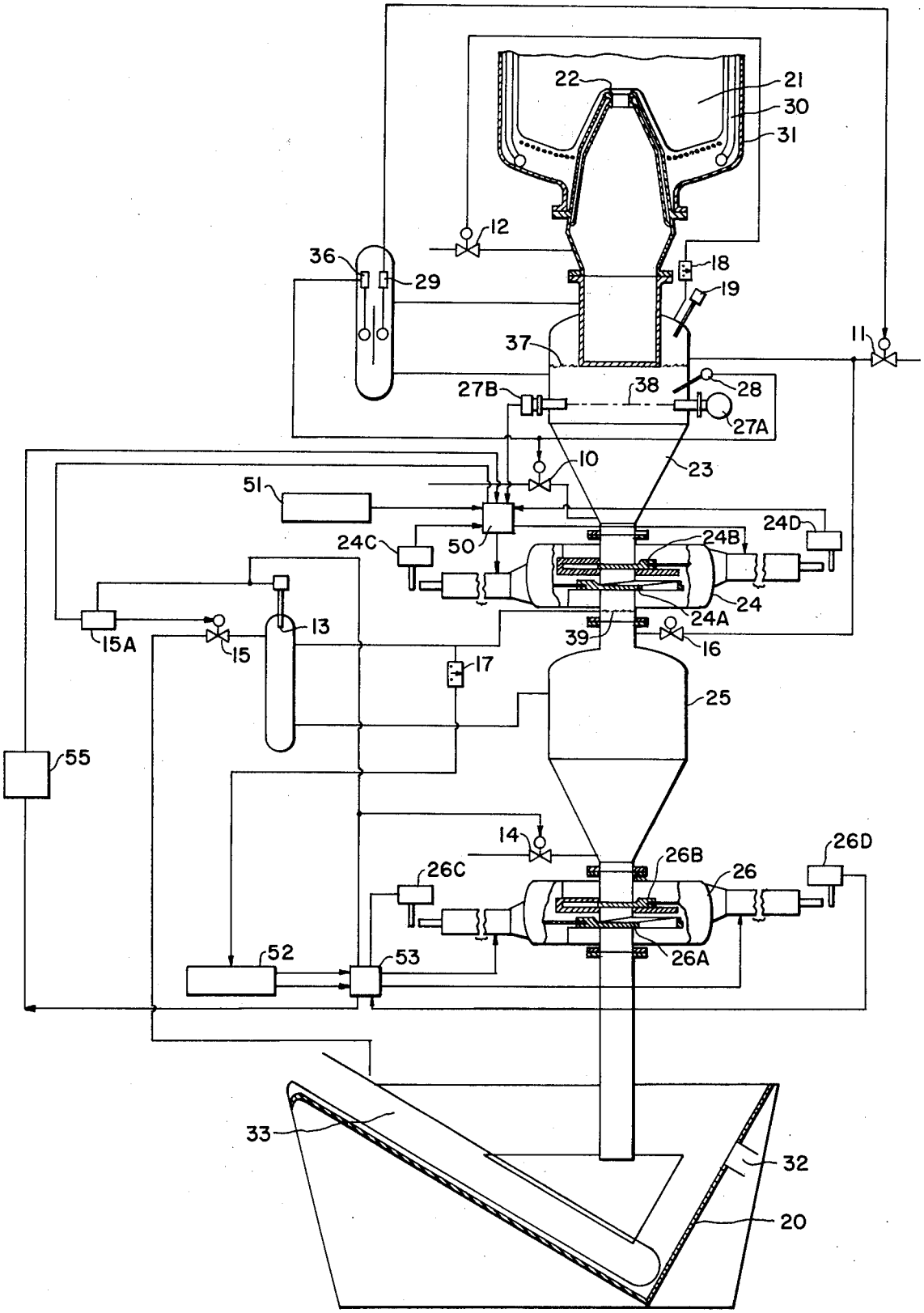
22
21
30
31
12
36
29
18
19
37
11
27B
38
28
27A
10
23
51
50
24C
24D
24B
24
24A
15A
15
13
39
16
17
25
55
14
26B
26D
26C
26
52
53
26A
33
32
20

APPARATUS FOR DISCHARGING HOT LIQUID MATERIAL FROM A PRESSURE VESSEL

BACKGROUND OF THE INVENTION

This invention relates to apparatus for discharging material in granular form together with a cooling liquid from a collecting vessel through a closable valve in the bottom of the collecting vessel. More particularly, the present invention relates to such a collecting vessel adapted to quench hot-liquid material discharged from an overflow in a pressure vessel disposed above the collecting vessel. The present invention is particularly useful to granulate and discharge slag passed from a slag bath generator while operating at an elevated pressure above atmospheric pressure.

There are several known processes which are carried out at an elevated temperature but these processes are only efficient when the process proceeds under an elevated pressure so that the dimensions of the treatment chambers can be reduced to an acceptable size, particularly in regard to chambers involving large throughput capacities.

As a rule, the processes taking place within pressure vessels, e.g., a slag bath generator, are carried out on a continuous basis whereby there is a continuous discharge of hot-liquid material which is cooled into granular form. It is important to avoid the need to employ apparatus having large physical dimensions to form the pressurized treatment chamber and the vessel in which the hot-liquid material is granulated by cooling. The hot-liquid material is slag in the case of a slag bath generator. To avoid the need for employing apparatus having large dimensions, it is necessary to make provisions for frequent depressurized delivery of the granulate which accumulates in the vessel.

An untolerable amount of labor is required to manually withdraw the granulate from the vessel. Moreover, inspection and monitoring of the level of material within a pressure vessel are very difficult if not impossible.

The residue from gas generators operating under an elevated pressure has been removed by employing a collecting vessel located below the pressure chamber and through the use of a sluice vessel that is filled with water and closed from the collecting vessel by a pivotal closure and ball valve. The residue is transferred into a buffer vessel located downstream by means of pressurized water under gas pressure provided by the pressure vessel so that the residue is discharged from the buffer vessel. A device of this type for removing the residue from gas generators is awkward and requires expensive additional apparatus.

SUMMARY OF THE INVENTION

It is an object of the present invention to provide an apparatus for discharging the hot-liquid material passed from a pressure vessel, e.g., liquid slag from a slag bath generator, into a coolant such as water during operation of the pressure vessel at an elevated pressure and to discharge the granulate formed by quenching the liquid material.

It is a further object of the present invention to provide an apparatus to discharge granules formed by quenching liquid slag from a slag bath generator in a manner such that the granules thus formed are automatically expanded in a brief time interval from the elevated pressure in the slag bath generator to atmospheric pressure by employing vessel means to quench the hot-liquid material and to discharge the granular material after quenching which vessel means are constructed in the form of apparatus having relatively small dimensions and adapted for operation in a simplified manner.

According to the present invention, hot-liquid material passed from an overflow in a treatment chamber is received in a collecting vessel which is filled with a coolant to a level maintained by a coolant supply and discharge means which is controlled by means such as a float. A valve, used to close the bottom of the vessel, is opened for passing the accumulated contents in the collecting vessel into an underlying discharge vessel which is filled with a coolant and closed at its bottom by means of a valve. The pressure within the discharge vessel is raised above atmospheric pressure to a level corresponding to the pressure within the collecting vessel by means further employed to reduce the pressure in the discharge vessel down to an ambient pressure.

The granular material which is formed by quenching the hot-liquid material in the coolant within the collecting vessel is discharged at a selected time to insure that the material settling in the bottom of the collecting vessel does not accumulate to a level which is above the liquid level in the collecting vessel. This insures the continued availability of a coolant in the collecting vessel to quench the hot-liquid material as it descends in a liquid state from the overlying treatment chamber for transformation into a granulate by quenching.

When the level of the granular material in the collecting vessel has reached a specific height, a valve in the bottom of the collecting vessel is opened to pass the granular material directly into a discharge vessel which is filled with a coolant. The granular material has a density substantially higher than the density of the coolant whereby the granular material descends from the collecting vessel solely under the effect of gravity and collects in the bottom of the discharge vessel. A valve in the bottom of the discharge vessel is closed during the passage of granular material thereto. After the valve between the discharge vessel and the collecting vessel is closed, the interior of the discharge vessel is expanded to atmospheric pressure whereupon the valve in the bottom of the discharge vessel is opened so that the granular material together with the coolant pass therefrom. The discharged mixture undergoes separation to discharge the coolant in pipes and transport the granulate by conveyor means to undergo further treatment. After the valve in the bottom discharge vessel is closed, this vessel is again filled with a coolant and pressurized to a pressure corresponding to the elevated pressure within the collecting vessel. The cycle for the discharge of granular material is then repeated.

The present invention further provides a control system for opening the valve in the bottom of the collecting vessel when the granulate material accumulates in the coolant therein to a predetermined height which is below the level of the coolant. The control system recloses the valve in the bottom of the collecting chamber after the accumulation of granular material is discharged from the collecting vessel into the underlying discharge vessel. The control system is also employed to reduce the pressure within the discharge vessel when filled with the granulate to an ambient pressure whereupon a valve in the bottom of the discharge vessel is opened. After the granulate has been emptied from the discharge vessel, the control system insures that the valve in the bottom thereof is reclosed and that the discharge vessel is again filled with a coolant. The pressure within the discharge vessel is then raised to the elevated pressure corresponding to the pressure within the collecting vessel by the control of appropriate valves.

The height to which the granulate collects in the coolant within the collecting vessel is limited to a predetermined level through the use of a radiation detector using isotopes. This detector includes a sender having a gamma source and a receiver in the form of a Geiger counter which provides an output signal in the form of electrical pulses. The receiver is adjusted so that the output pulses remain unaffected by the passage of the radiation from the sender through the walls of the collecting vessel and the coolant, but at the same time, so that the output signal will respond to an absorption of the gamma source by an accumulation of slag to a predetermined level. Such a controlled adjustment is effective since the slag contains elements with a higher atomic number.

Electrical interlocking is employed to insure that the discharge processes are performed in the intended sequence. For this purpose, the electrical interlock also controls the operation of the valves in the bottom of the collecting vessel, the valves in the bottom of the discharge vessel, the valves which control the supply of a coolant to the discharge vessel, the pressure relief and pressure loading valves for the discharge vessel and the valve used for pressure equalization between the collecting vessel and the discharge vessel.

These features and advantages of the present invention as well as others will be more fully understood when the following description is read in light of the accompanying drawing wherein there is illustrated a vertical section through the bottom of a slag bath generator interconnected with a collecting vessel and a discharge vessel together with control apparatus according to the present invention.

As illustrated in the drawing, a slag bath is formed in a slag trough 21 forming part of a slag bath generator having a reactor shell 31 which incorporates coolant pipes 30. Liquid slag accumulates in the trough 21 from where it is discharged through an overflow 22 into a coolant liquid, namely, water which forms a quenching medium disposed in a collecting vessel 23. Reference numeral 37 identified a desired coolant level which is to be maintained between two limit levels by means of two float regulators 29 and 36. A water control valve 10 is used to feed a coolant into the collecting chamber and a water control valve 11 is used to control the withdrawal of the coolant from the collecting chamber when, for example, the level of the coolant exceeds the desired liquid level 37. A pressure relief valve 12 prevents the occurrence of an excessive pressure within the slag bath generator which typically forms part of a gasification chamber. A pressure control switch 18 provides a signal to control the pressure relief valve 12 to avoid the development of an excessive gaseous pressure within the top part of the collecting chamber because as granular material accumulates in the collecting vessel this affects the gas pressure. A detector in the form of a level probe 19 projects through the wall of the collecting vessel above the desired coolant level 37.

In the drawing, reference numeral 38 indicates the maximum level of granulate permitted to accumulate after descending below the desired coolant level in the collecting vessel 23. When the granulate accumulates to the level 38, the granulate lies within a region between a gamma radiation sender 27A and a radiation receiver 27B. The granulate decreases the output signal from the radiation receiver 27B. This output signal is usually in the form of pulses which, in turn, provides a signal to open a duplex gate valve 24. Gate valve 24 includes a circular bottom gate 24A employed to provide a hermetic closure. Bottom gate valve 24A opens first which is followed by the opening of a top circular gate valve 24B. A thermal detector switch 28 provides a signal used by a controller, not shown, for valves 10 and 11 to increase the coolant feed rate when a predetermined temperature is exceeded within the collecting vessel 23.

Underlying the collecting vessel 23 is a discharge vessel 25 which is filled with coolant to a desired coolant level indicated by reference numeral 39. A pressure equalization valve 16 communicates with the interior of the discharge vessel 25 and when this valve is open, a pipeline 16A equalizes the pressures in the discharge vessel 25 and collecting vessel 23. A shutoff valve 14 is provided in a coolant supply line connected to the discharge vessel. A liquid level probe 13 extends downwardly within a chamber 13A coupled by pipelines to the discharge vessel 25. The probe 13 provides a control signal to close valves 14 and 15 when the coolant level within the discharge vessel reaches the desired coolant level 39. Valve 15 is a vent control valve used to depressurize the discharge vessel 25 via chamber 13A to atmospheric pressure. A pressure switch 17 provides a signal corresponding to the pressure within the discharge vessel. A duplex gate valve 26, constructed in the same manner as duplex gate valve 24, has two circular valve gates 26A and 26B. A collecting vessel 20 underlies the discharge end of the duplex gate valve 26 to receive the mixture of water and granular material passed from the discharge vessel 25. The collecting vessel 20 includes a water discharge pipe 32 and a scraper conveyor 33 which conveys the granulated slag from the collecting vessel 20.

In the operation of the apparatus of the present invention, liquid slag is discharged continuously from the slag trough 31 via the overflow 22 from where the slag descends into the coolant water within the collecting vessel 23. The hot liquid slag is quenched by the coolant water and thereby transformed into granulate which descends in the cooling water within the collecting vessel to the bottom where it accumulates above the valve gate 24B. When the level of the granulate in vessel 23 accumulates to level 38, receiver 27B delivers modified output pulses to controller 50 which is coupled to timer 51 for operating the duplex valve 24. Valve gates 24A and 24B are thereby controllably opened according to the sequence as previously described, i.e., lower valve gate 24A opens first which is followed by opening of the upper valve gate 24B. After valve 24 is open, the granulate descends into the water-filled discharge vessel 25 and collects above the duplex gate valve 26. The gate valves 24A and 24B are then closed which is indicated by feedback signals from limit switches 24C and 24D, respectively. A control signal is delivered by controller 50 to a valve controller 15A for operating valve 15 so that the discharge vessel 25 is then depressurized.

When the discharge vessel 25 is expanded to atmospheric pressure, pressure switch 17 sends a signal to timer 52 which, in turn, delivers timing signals to controller 53 to open the duplex gate valve 26. The coolant water and granulate pass into the collecting vessel 20. Limit switches 26C and 26D provide feedback bype of interlock signals to the controller 53 to indicate the operative position of the gate valves 26A and 26B, respectively.

After the discharge vessel 25 is emptied, the duplex gate valve 26 is again closed by a control signal from timer 52. Valve 14 is then opened by controller 53 to fill the discharge vessel with water. Valve 15 remains open to allow entrapped air within the discharge vessel to escape into the atmosphere. After the discharge vessel is completely filled with water, valves 14 and 15 are closed. Valve 16 is opened by a small amount to establish a pressure equalization between the then-existing elevated pressure within the collecting vessel 23, which is above atmospheric pressure, and the pressure in the discharge vessel 25.

The level of the cooling water within the collecting vessel 23 is maintained constant by the two float regulators 29 and 36. The regulator 36 controls the inlet valve 10 which is opened when the level of the liquid in the collecting vessel lies below the desired normal level. The regulator 29 controls discharge valve 11 which is opened when the liquid level in the collecting vessel exceeds the desired level.

The temperature of the cooling water in the collecting vessel 23 is maintained constant through the use of the thermal switch 28. As previously indicated, thermal switch 28 provides a signal which is used to control the inlet valve 10. An electrical interlock 55 is used for the sequential operation of valves 24, 26, 14, 15 and 16.

The duplex gate valve 26 is closed by a timing signal after the appropriate time has elapsed for the passage of the mixture of water and granulate from the discharge vessel. The limit switches for the duplex gate valve 26 provides an electrical signal for opening the inlet valve 14. The liquid level probe 13 provides a signal to close valves 14 and 15 after the desired liquid level has been reached. After the pressure equalization occurs between vessels 23 and 25, the pressure equalization valve 16 is closed by means of pressure switch 18. The pressure switches 17 and 18 as well as the liquid level probe 19 provide electrical signals to monitor the correct operation of the discharge apparatus and to provide signals to indicate any defective operation.

Although the invention has been shown in connection with a certain specific embodiment, it will be readily apparent to those skilled in the art that various changes in form and arrangement of parts may be made to suit requirements without departing from the spirit and scope of the invention.

We claim as our invention:

1. In a pressure vessel having an overflow member to discharge hot liquid material into a liquid coolant contained within an underlying collecting vessel wherein said hot liquid material is transformed by quenching into solid granular material, the improvement including the combination of:

coolant supply and discharge means for said collecting vessel, control means for maintaining a constant coolant level within said collecting vessel under a pressure above atmospheric pressure, valve means in the bottom of said collecting vessel adapted to discharge said solid granular material after accumulating to a predetermined level within the liquid coolant, a discharge vessel for receiving solid granular material discharged beyond said valve means from said collecting vessel, said discharge vessel being adapted to be filled with a liquid coolant at atmospheric pressure and at a pressure above atmospheric pressure which corresponds to the pressure within said collecting vessel, and valve means in the bottom of said discharge vessel for discharging said solid granular material together with a liquid coolant from the discharge vessel.

2. The improvement according to claim 1 further comprising detector means for providing a signal corresponding to an accumulation of granular material in the liquid within said collecting vessel.

3. The improvement according to claim 1 further comprising means for electrically interlocking said valve means in the bottom of said collecting vessel and said valve means in the bottom of said discharge vessel.

4. The improvement according to claim 1 wherein said control means includes a regulator having float means to detect the liquid coolant level within said collecting vessel.

5. The improvement according to claim 1 further comprising a liquid coolant supply line including control means coupled to said discharge vessel.

6. The improvement according to claim 1 further comprising means including a pressure relief valve for controlling the pressure of the liquid coolant within said discharge vessel.

7. The improvement according to claim 1 further comprising means including a valve for controlling the equalization of a liquid coolant pressure in said collecting vessel and said discharge vessel.

8. The improvement according to claim 1 further comprising means underlying said discharge vessel for receiving the solid granular material passed from the valve means in the bottom of the discharge vessel.

9. The improvement according to claim 8 further comprising conveyor means for transporting the solid granular material from said means underlying the discharge vessel.

10. The improvement according to claim 9 further comprising means for discharging a liquid coolant from said means underlying the discharge vessel.

* * * * *